US005699846A

United States Patent [19]

Ohanesian

[11] Patent Number: 5,699,846

[45] Date of Patent: Dec. 23, 1997

[54] WAND-CONTROLLED SPLIT-DRAW VERTICAL BLIND HEADRAIL

[75] Inventor: Harout Ohanesian, Northridge, Calif.

[73] Assignee: U.S. Polymers, Inc., Commerce, Calif.

[21] Appl. No.: 597,669

[22] Filed: Feb. 7, 1996

[51] Int. Cl.[6] ..... E06B 9/36

[52] U.S. Cl. ..... 160/168.1 V; 160/173 V; 160/900; 160/118

[58] Field of Search ..... 160/168.1 V, 173 V, 160/118, 119, 345, 346, 900; 16/87.4 R, 93 D

[56] References Cited

U.S. PATENT DOCUMENTS

| | | | |
|---|---|---|---|
| 3,061,003 | 10/1962 | Cureton | 160/168.1 V |
| 3,134,428 | 5/1964 | Kehrer et al. . | |
| 3,159,204 | 12/1964 | Kruell . | |
| 3,269,453 | 8/1966 | Vecchiarelli et al. . | |
| 3,343,588 | 9/1967 | Cayton . | |
| 3,367,390 | 2/1968 | Toti . | |
| 3,463,219 | 8/1969 | Oterholz . | |
| 3,605,852 | 9/1971 | Vecchiarelli . | |
| 3,878,877 | 4/1975 | Brunear et al. . | |
| 4,262,728 | 4/1981 | Debs | 160/168.1 V |
| 4,316,493 | 2/1982 | Arena . | |
| 4,657,060 | 4/1987 | Kaucic . | |
| 4,936,369 | 6/1990 | Darner . | |
| 5,088,542 | 2/1992 | Biba et al. | 160/168.1 V |

FOREIGN PATENT DOCUMENTS

| | | |
|---|---|---|
| 7539579 | 4/1976 | Germany . |
| 2526275 | 12/1976 | Germany . |
| 1337279 | 11/1970 | United Kingdom . |

*Primary Examiner*—Blair Johnson
*Attorney, Agent, or Firm*—Joseph C. Andras

[57] ABSTRACT

A split-draw vertical blind system uses a plurality of slat carriers, the slat orientation of which is controlled by a spline rod which passes through the carriers. Each carrier bears wheels to enable the carrier to glide smoothly along tracks provided by an enclosing headrail. In addition, a master carrier which a user may move by means of an attached wand is connected by hollow rivets to a stabilizer assembly which bears extra sets of wheels to contact the tracks and the inner surfaces of the headrail top to prevent binding of the master carrier. A horizontally-oriented closed loop of cord passes through bores on either side of the carriers and around pulleys or U-shaped components at the ends of the headrail. The cord loop is attached on opposite sides to the two center carriers, one of which is the master carrier. When the master carrier is moved by means of the wand, the other center carrier is moved in the opposite direction by the cord loop. As the master carrier and the other center carrier move towards opposite ends of the headrail, they push the other carriers towards their respective ends, thereby producing the desired split draw opening. When the process is reversed and the center carriers are moved towards the center, a series of interlocking tongues connecting each carrier to its endward neighbor pull the carriers towards the center to create an evenly-spaced closed blind.

14 Claims, 7 Drawing Sheets

WAND-CONTROLLED SPLIT-DRAW VERTICAL BLIND HEADRAIL

BACKGROUND OF THE INVENTION

1. Field of the Invention

The invention generally concerns the field of draperies and shades—devices to cover windows—and, more specifically, vertically-oriented adjustable blinds.

2. Description of Related Art

Blinds or louvers are well known as devices to cover windows and provide adjustable passage of light and air. Unlike traditional cloth draperies and pull shades, blinds are able to more fully modulate the passage of air and light. When a shade or drapery is closed, it prevents the passage of both light and air. To see through the covered window the curtain or shade must be opened. However, when a window is covered with a blind, the pitch of individual slats can be altered so that the slats are either perpendicular to the window pane or parallel to the pane. In the parallel orientation the slats overlap, effectively cutting off passage of light and air. In the perpendicular orientation both light and air can readily pass, while in between positions partially block both light and air.

Horizontal blinds such as "venetian blinds" are quite prevalent but suffer from several drawbacks. First, since they operate by gravity, the blinds must be pulled up towards the top edge of the window to be opened and must be pulled towards the bottom edge of the window to be placed in the closed position. On the other hand, most traditional draperies close the window by moving from one side to the other side or from the sides of the window towards the center (split-draw). This type of operation is more convenient for blocking sun entry without obscuring the whole window. Second, since the blinds' major length is disposed horizontally, it becomes a significant dust collector and, to make matters worse, horizontal blinds are notoriously hard to clean.

Many of the drawbacks of horizontal blinds are solved by vertically-oriented blinds. Here the individual slats are oriented with their long axes disposed vertically so that they are no longer dust catchers. Usually each slat depends from an individual carrier that slides from side to side in a horizontally-oriented track. Thus, the blinds may be configured to be drawn from either side of the window or from both sides simultaneously as a split draw. Because the slats are suspended individually, it is possible to replace single slats that become damaged, a process that is virtually impossible with traditional venetian blinds.

The individual slat carriers also provide a mechanism to synchronously rotate the slats about their longitudinal axes. Thus, the degree of light or air passage can be readily controlled. However, the various mechanisms used to rotate the slats contribute to the complexity and cost of vertical blinds. Further, because the blinds do not close by the force of gravity, a more or less complex system of cords and pulleys is needed to ensure opening and closing. This means that two fairly complicated control systems must interact.

One common way to control the rotation of the slats is to provide a splined rod which either passes through the individual slat carriers or is in contact with the carriers as they move laterally in a headrail of a vertical blind system. An arrangement of gears then links each vertical slat to the splined rod. When the splined rod is rotated, is causes the engaged gear trains to rotate the individual slats about their longitudinal axes. Generally some sort of pulley arrangement with a cord or ball chain is provided to rotate the splined rod. For example, see U.S. Pat. No. 4,657,060 to Kaucic.

An endless loop of cord is also generally provided to effect the opening and closing of the blind. For blinds that have a one-way draw, i.e., open or close by moving from one edge of the window to the other, the ends of the cord can be fastened to a master carrier with a loop of the cord descending from the side of the headrail. Pulling one side of the loop causes the carrier to move towards one edge of the window, while pulling the other side of the loop causes the master carrier to move towards the opposite edge. Unfortunately, loops of cord descending from the blind can present a strangulation danger to small children. Further, if the cords to control opening are at the same end of the headrail as the cords that control blind rotation, a tangled mess can result.

A number of different product configurations have been tried in an attempt to cope with the above-described problems. U.S. Pat. No. 4,936,369 to Darner describes the use of a tilt wand that is disposed in mechanical connection with the splined rod to permit adjustment of the slat rotation without requiring a hanging loop.

U.S. Pat. No. to 4,316,493 to Arena discloses a rod or wand attached to the master carrier on a vertical blind assembly. The wand can be used to draw the one-way draw blind much as a cloth drapery can be closed or opened by pulling on a leading edge of the curtain. Furthermore, the wand is in mechanical communication with the splined rod so that twisting the wand controls the rotational position of the vertical slats. However, moving the master carrier with a rod may cause the carrier to tilt in its track and bind. Further, the usual arrangement of components in a split-draw system ordinarily does not lend itself readily to opening and closing by means of a wand.

Thus far the art has not provided a split draw vertical blind that is both easy to use and relatively uncomplicated to manufacture.

OBJECTS AND SUMMARY OF THE INVENTION

Therefore, it is an object of the present invention to provide a reliable split-draw vertical blind that can be opened and closed by means of a wand;

It is another object of the present invention to provide a wand-driven stabilizer for use on a carrier of a split-draw vertical blind so that the carrier resists binding; and It is a further object of the present invention to provide a simple means to attach the wand driven stabilizer to an ordinary carrier, thus minimizing the complexity of molded parts.

These and other objects are met with a split-draw vertical blind system which uses a plurality of slat carriers, the slat orientation of which is controlled by a spline rod passing through the carriers. Each carrier bears wheels to enable the carrier to glide smoothly along tracks provided by an enclosing headrail. In addition, a master carrier which a user can move by means of an attached wand is connected by hollow rivets to a stabilizer assembly which bears extra sets of wheels to contact the tracks and the inner surfaces of the headrail top so as to prevent binding of the master carrier. A horizontally-oriented closed loop of cord passes through bores on either side of the carriers and around pulleys or U-shaped components at the ends of the headrail. The cord loop is attached on opposite sides to two center carriers, one of which is the master carrier. When the master carrier is moved by means of the wand, the other center carrier is moved in the opposite direction by the cord loop. As the master carrier and the other center carrier move towards opposite ends of the headrail, they push the other carriers towards their respective ends of the headrail, thereby producing the desired split draw opening. When the process is reversed and the center carriers are moved towards the center, a series of interlocking tongues connecting each carrier to its endward neighbor pull the carriers towards the center to create an evenly-spaced closed blind.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a split-draw vertical blind headrail with wand-controlled opening and closing.

Figure 1:
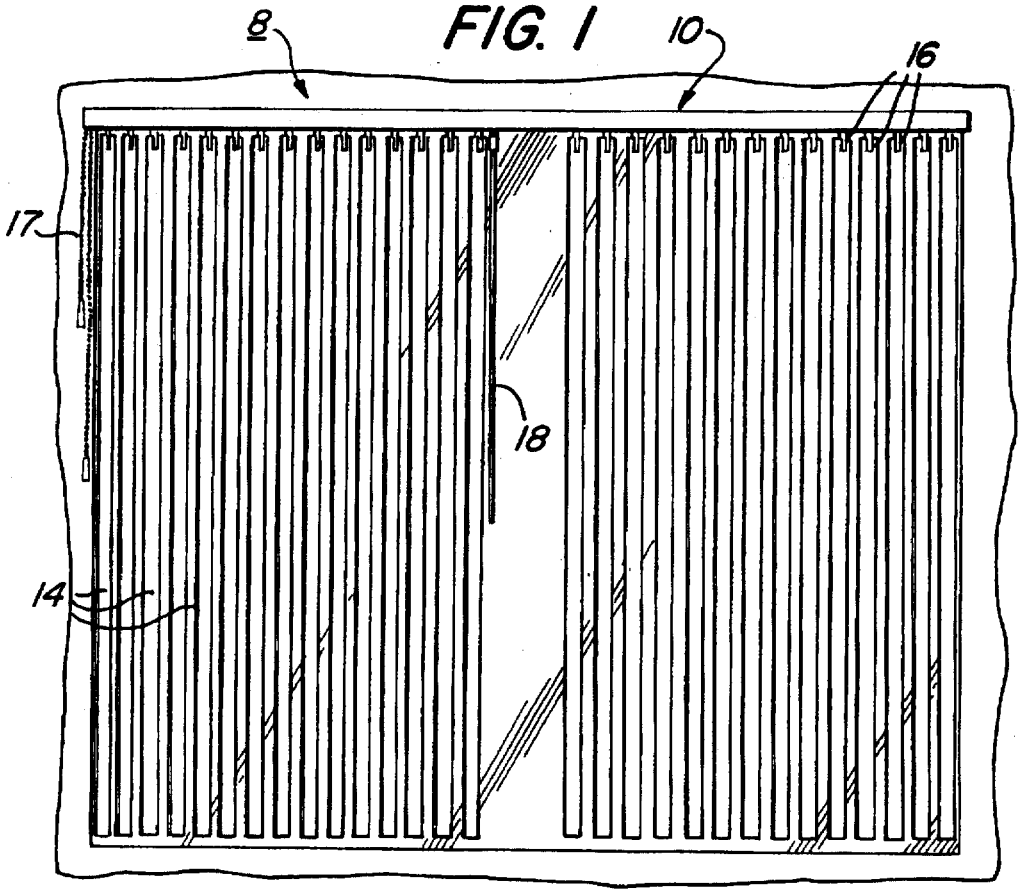
FIG. 1 shows a view of the present invention installed in a window.

FIG. 1 shows a view of a blind 8 of the present invention installed on a typical window. A headrail 10 provides a frame for the entire blind 8. From the headrail 10 a number of slats 14, each one attached to a clip 16 which, in turn, forms part of a carrier 30. A wand 18 is attached by means of a socket 31 and rivet 33 to a master carrier 32 and is used to open or close the blind 8. A ball chain 17 depends from the headrail 10 from the first end cap 6 and is used to adjust the rotation of the clips 16 and the attached slab 14.

Figure 3:
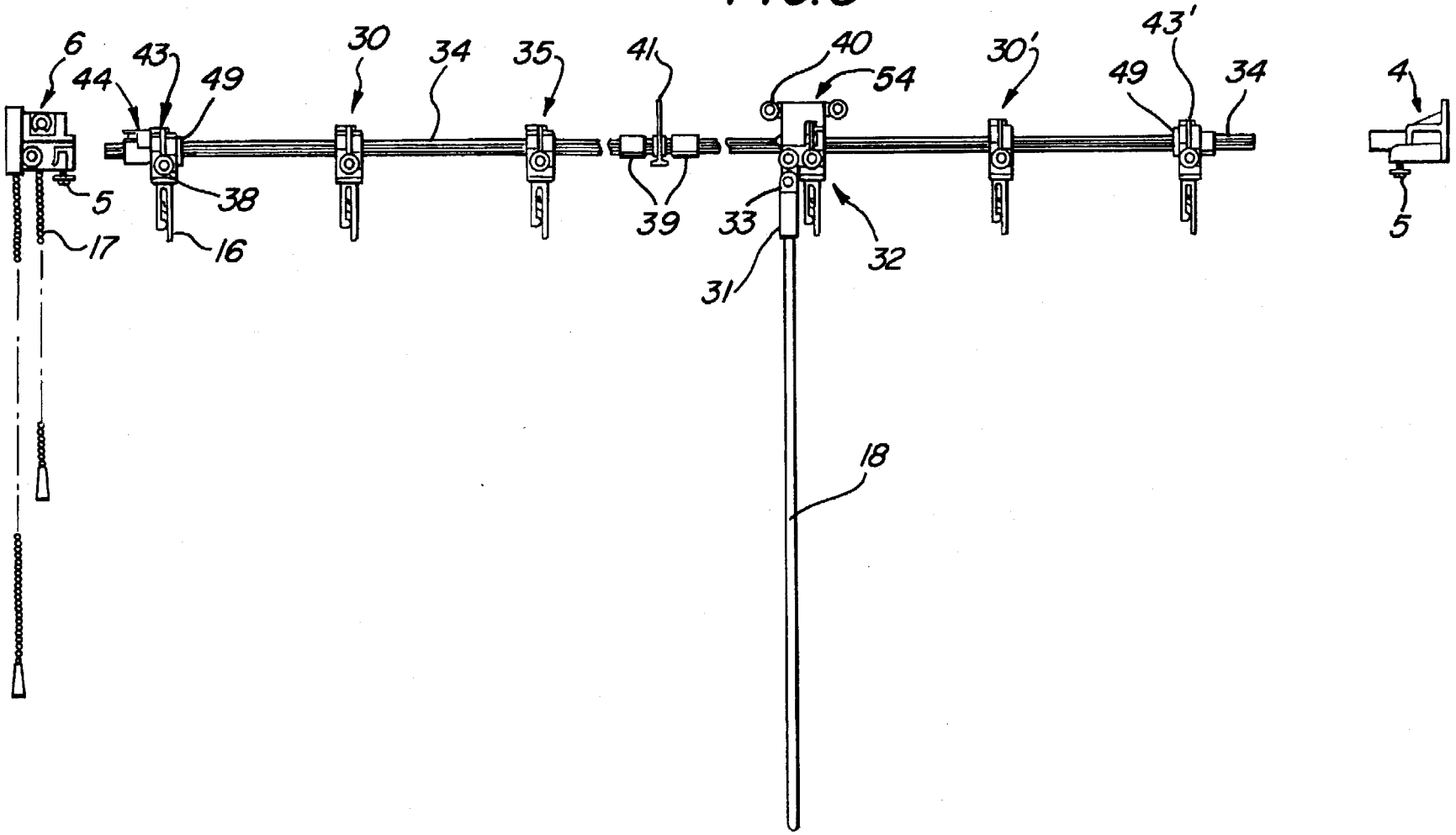
FIG. 3 shows the interior mechanism of the present invention.

The headrail 10 is actually formed as a hollow metal extrusion (see FIG. 3). Ends of the headrail 10 are closed by a first end cap 6 and a second end cap 4 which are sized to be inserted into the hollow of the headrail 10. The end caps 4, 6 are fixed in place by end brackets 5 which attach to the headrail 10. A splined rod 34 is suspended between the end caps 4, 6.

Figure 2:
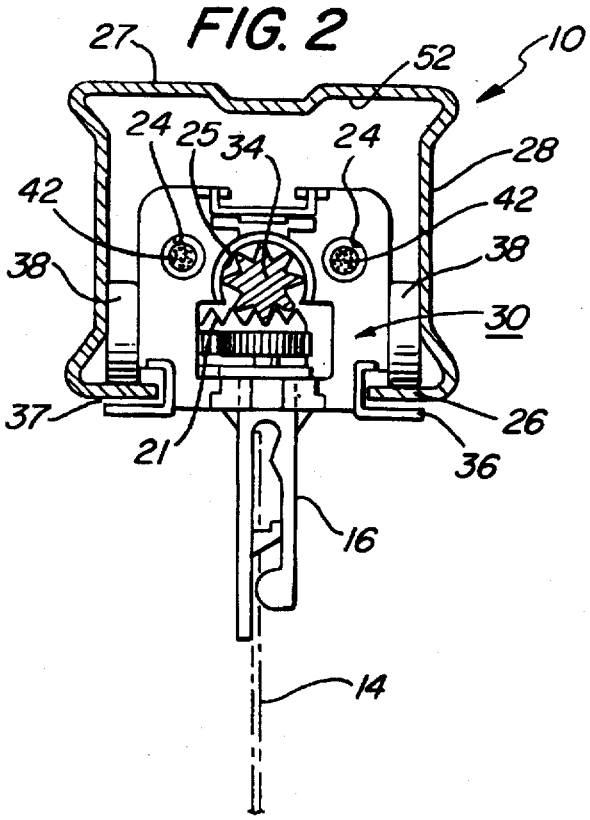
FIG. 2 shows a cross-section of the present invention.

FIG. 3 shows the inner mechanism of the blind 8 with the headrail 10 removed. The splined rod 34 which passes through an aperture 25 in each carrier 30. Each carrier 30 also has two retaining ledges 36 and two wheels 38 arranged so as to define a small space 37 between the ledges 36 and wheels 38. As shown in FIG. 2, the space 37 is occupied by a retaining track 26 that comprises a turned in end of sidewalls 28. The retaining track 26 holds the carriers within the headrail 10, and provides a smooth surface along which the carriers 30 ride.

Figure 4:
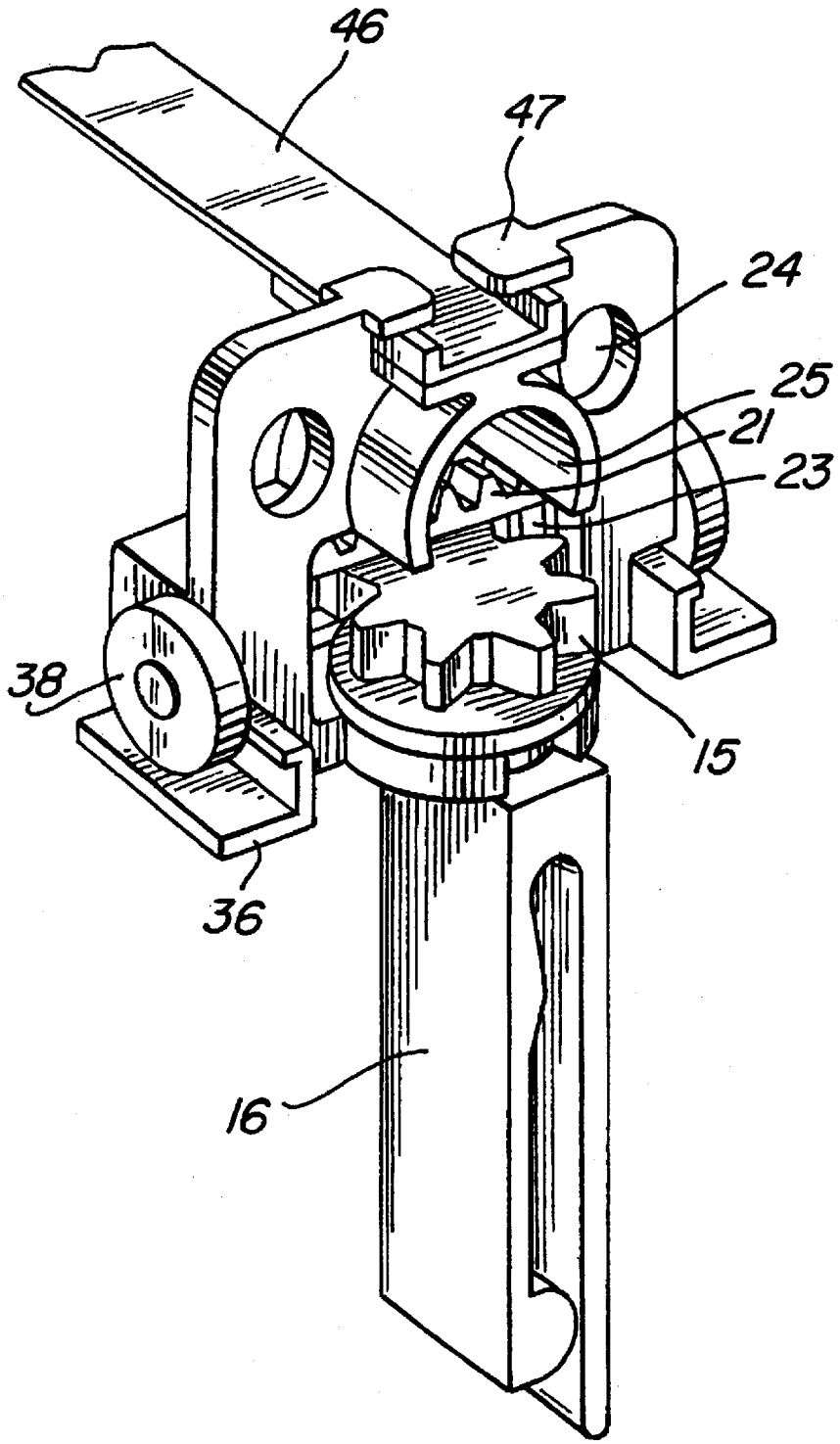
FIG. 4 shows a detail of the mechanism of a carrier used in the present invention.

As shown in FIGS. 2 and 4, each carrier also comprises a linear gear 21 which engages the splined rod 34 so that the linear gear 21 slides from side to side when the splined rod 34 rotates along its longitudinal axis. The linear gear 21 also comprises a lateral gear surface 23 that engages a rotary gear 15 that forms an upper end of the clip 16. Thus, when the splined rod 34 is rotated, the linear gear 21 and the lateral gear surface 23 move from side to side, causing the rotary gear 15 to rotate the entire clip 16 and the attached slat 14.

Figure 8:
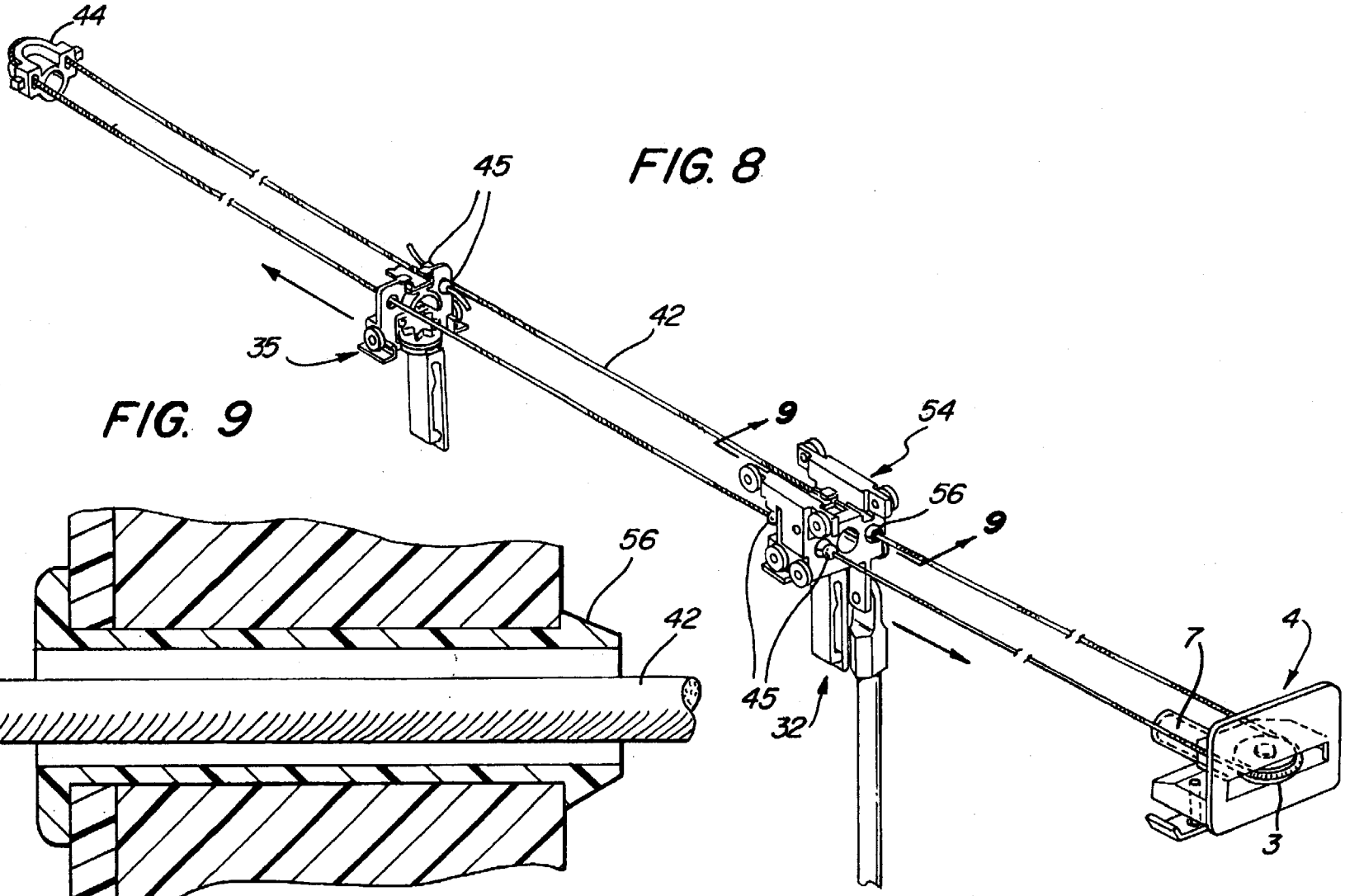
FIG. 8 illustrates the attachment of a master carrier and a retaining carrier to a cord in the present invention.
Figure 9:
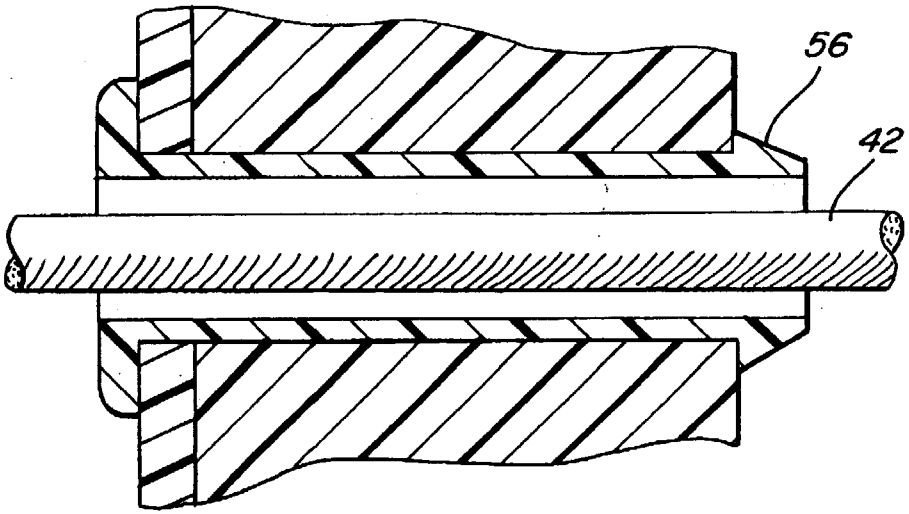
FIG. 9. shows a cross-section of a hollow rivet of the present invention.

Each carrier 30 also has two bores 24 through which a cord 42 passes (see FIGS. 2 and 8). The cord 42 is used to move the carriers 30 from an opened position to a closed position. Because this is a split-draw unit, the carriers 30 are arranged in two groups. The groups are separated by a partition 41 and spacers 39 which prevent the carriers 30 of a first group from contacting the carriers 30' of a second group. The carriers 30 to the left of the partition 41 move to the left when the blind 8 opens, while those to the right move right. The carrier closest to the partition on the right is the master carrier 32; a retaining (slave) carrier 35 on the other side of the partition 41 has the same structure as the other carriers 30 but engages the two ends of the cord 42.

The cord 42 forms a closed loop. A first end of the cord 42 is captured by one of the bores 24 of the retaining carrier 35 on a first side of the loop. From that end the cord 42 then passes through the first side bores 24 of the carriers 30 located on the retaining carrier 35 side of the partition 41. Then the cord 42 passes around a U-shaped piece 44 at the first end cap 6 end of the headrail 10 to form a second side of the loop. The U-shaped piece 44 also has a central aperture 25 through which the splined rod 34 passes. Tension of the cord 42 pulls the U-shaped piece 44 against a second end carrier 43' which is prevented from sliding towards the center of the splined rod 34 by a circlip 42, engaging the splined rod 34. The first end cap 6 contains a worm gear driven by a coaxial chain pulley (not illustrated). Rotation of the worm gear causes the rotation of a spline gear which is coaxially engaged with the splined rod 34 so that pulling on the ball chain 17 rotates the splined rod 34 and, thereby, the vertical slats 14.

The cord 42 then passes through all the bores 24 on the second side of the splined rod 34. As the cord 42 passes through the bore 24 of the master carrier 32 the cord 42 is effectively captured by the master carrier 32 by two ferrules 45 which are crimped to the cord 42 on either side of the bore 24 and are too large to pass through the bore 24 (see FIG. 8). After passing through the rest of the carriers 30, the cord 42 passes around a pulley 3 which forms part of the second end cap 4. The second end cap 4 includes a short spacer 7 which, in turn, like the U-shaped piece 44, abuts the end carrier 43 fixed in place by the circlip 42. Then the cord passes through the remaining bores 24 on the first side of the splined rod 34 until it reaches the retaining carrier 35, where the second end of the cord is retained in the same bore 24 that retains the cord's first end.

FIG. 8 illustrates the interaction of the carriers 30 with the cord 42 by showing an imaginary view in which the splined rod 34 has been removed to reveal the looped cord 42.

Because the retaining carrier 35 is attached to both ends of the cord 42 it moves whenever the cord 42 is moved. As mentioned earlier, the blind 8 is normally opened by moving the master carrier 32 by means of the wand 18. Whenever the master carrier is moved, the cord, captured by the ferrules 45, moves, slipping through the bores 24 and around the U-shaped piece 44 and the pulley 3. As the cord 42 moves, it also drags the retaining carrier 35. The cord 42 is so arranged that when the master carrier 32 is moved away from the partition 41 opening the blind 8 on the first side of the partition 41, the retaining carrier 35 moves in the opposite direction—also away from the partition 41—opening the blind 8 on the second side of the partition 41. Likewise, when the master carrier 32 is moved towards the partition to close the blind 8, the carrier 35 moves towards the partition 41 to close the blind 8.

To understand this opening and closing action, one must realize that, except for their connection to the retaining carrier 35 and the master carrier 32, the cord 42 moves independently of the carriers 30, slipping freely through the bores 24. As the cord 42 moves, it pulls the master carrier 32 and the retaining carrier 35 in opposite directions because the two carriers are attached to opposite sides of a closed loop formed by the cord 42. Clearly, it is unimportant whether the ends of the cord are fixed to the retaining carrier 35 (as just detailed) or to the master carrier 32. What matters is that the two carriers are attached to opposite sides of the loop so that they will move in opposite directions, creating a split-draw.

Figure 5:
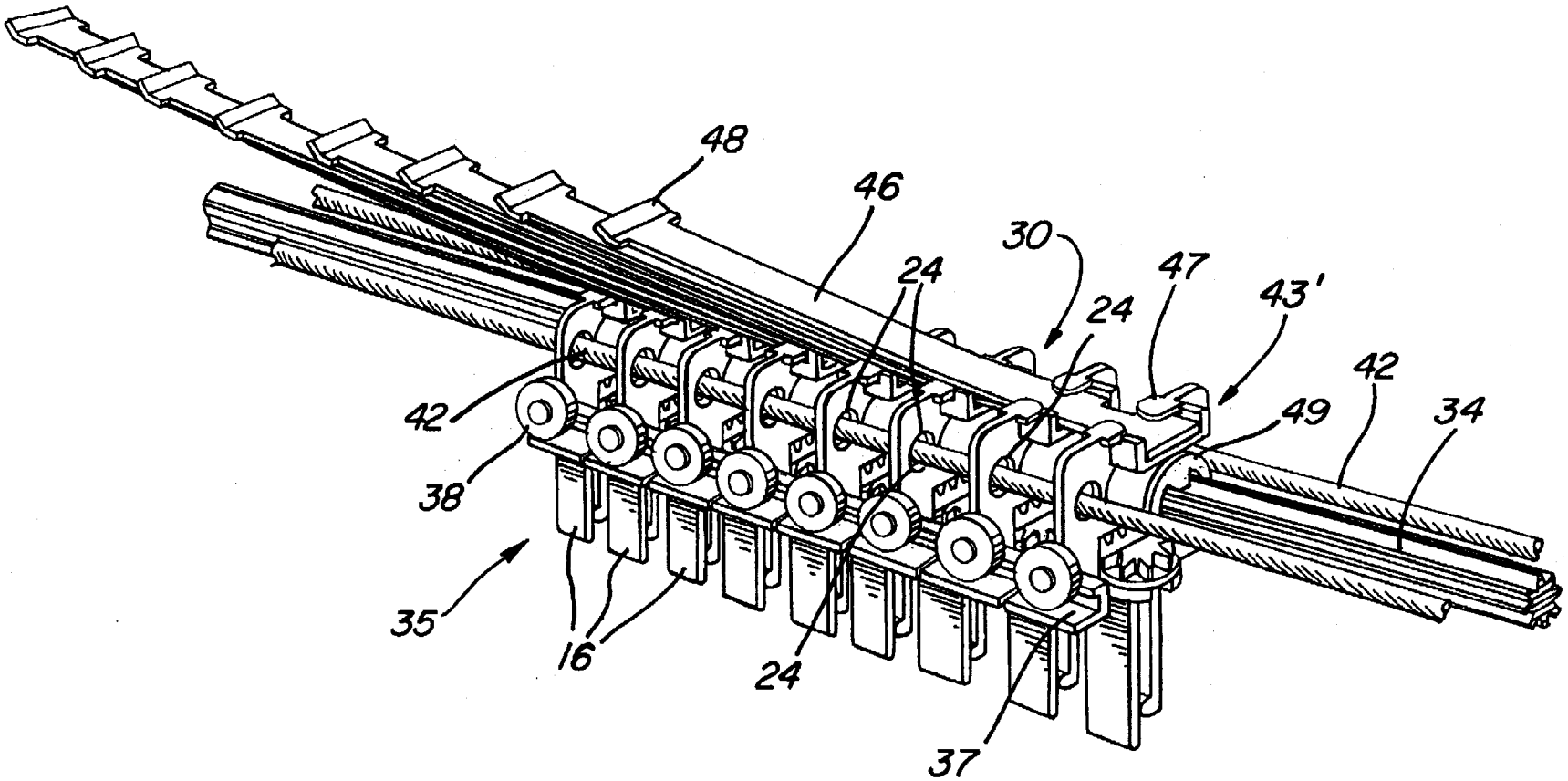
FIG. 5 shows the carriers of the present invention pushed together as when the blind is open.
Figure 6:
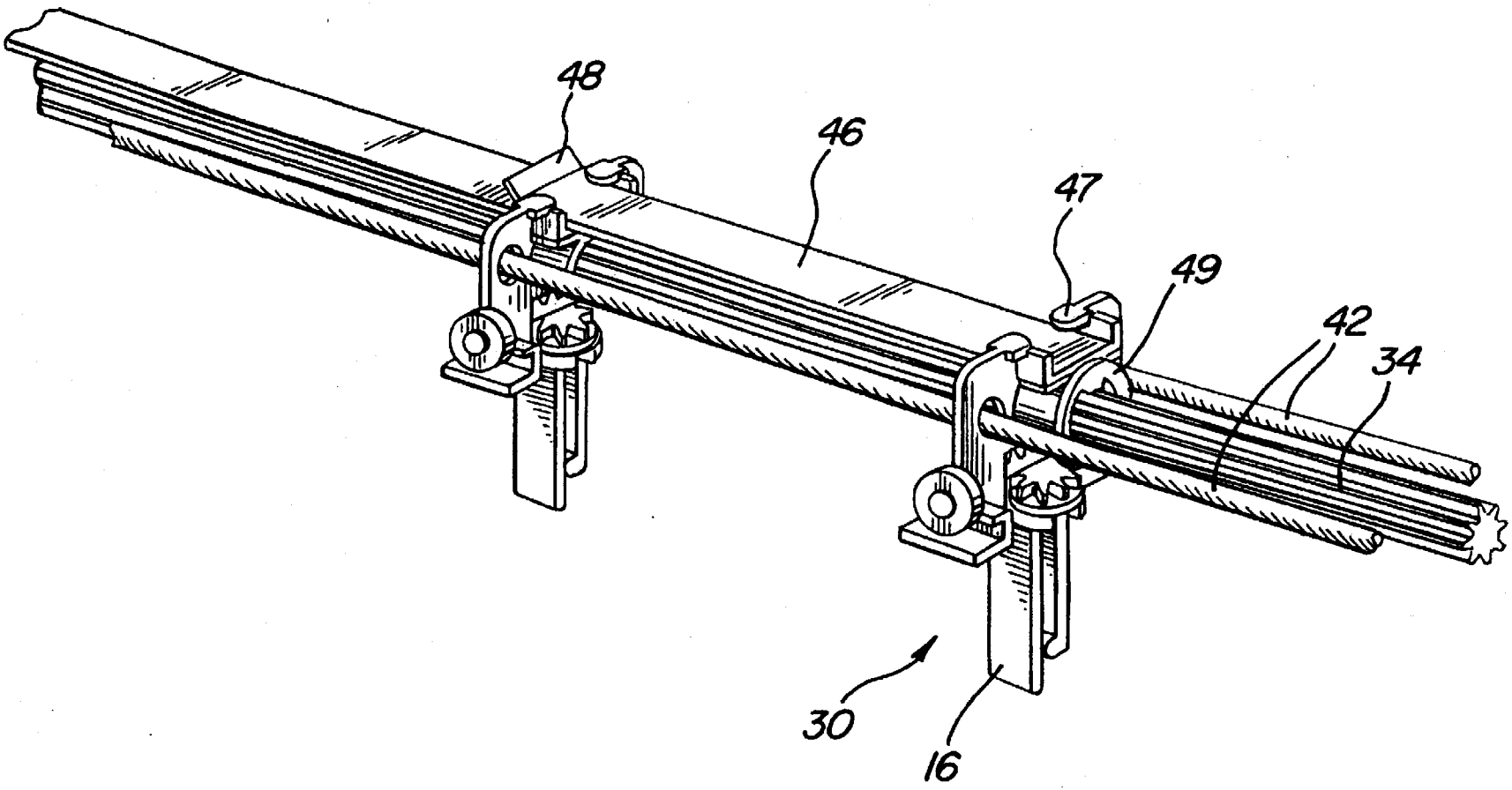
FIG. 6 shows the carriers being pulled by sliding tongues as when the blind is being closed.

As just explained, only the master carrier 32 and the retaining carrier 35 are actually linked to the cord 42. When the blind 8 is opened, the master carrier 32 and the retaining carrier 35 collide with the other carriers 30 and push them to the ends of the headrail 10 (see FIG. 5). However, when the blind 8 is closed by moving the master carrier 32 and the retaining carrier 35 towards the center of the headrail 10, a series of overlapping tongues 46 attached to the carriers 30, 30' ensure the movement of the carriers 30, 30' as illustrated in FIG. 6. Each tongue 46 is attached to one of the carriers 30, 30' and passes slidingly through a pair of retaining brackets 47 on the next carrier 30, 30'.

As the master carrier 32 or the retaining carrier 35 move towards the partition 41, the tongues of their respective neighboring carriers 30, 30' slip through the retaining brackets 47 until a T-shaped end 48 of each tongue reaches the retaining bracket 47. Since the T-shaped end 48 cannot pass through the retaining bracket 47, the entire carrier 30, 30' to which the tongue 46 is attached is pulled along. This causes the tongue 46 to slip through the next retaining bracket 47 and so on. In this way all the carriers 30, 30' are eventually pulled towards the center of the splined rod 34 and end up spaced evenly apart by a length of the tongue 46.

Figure 7:
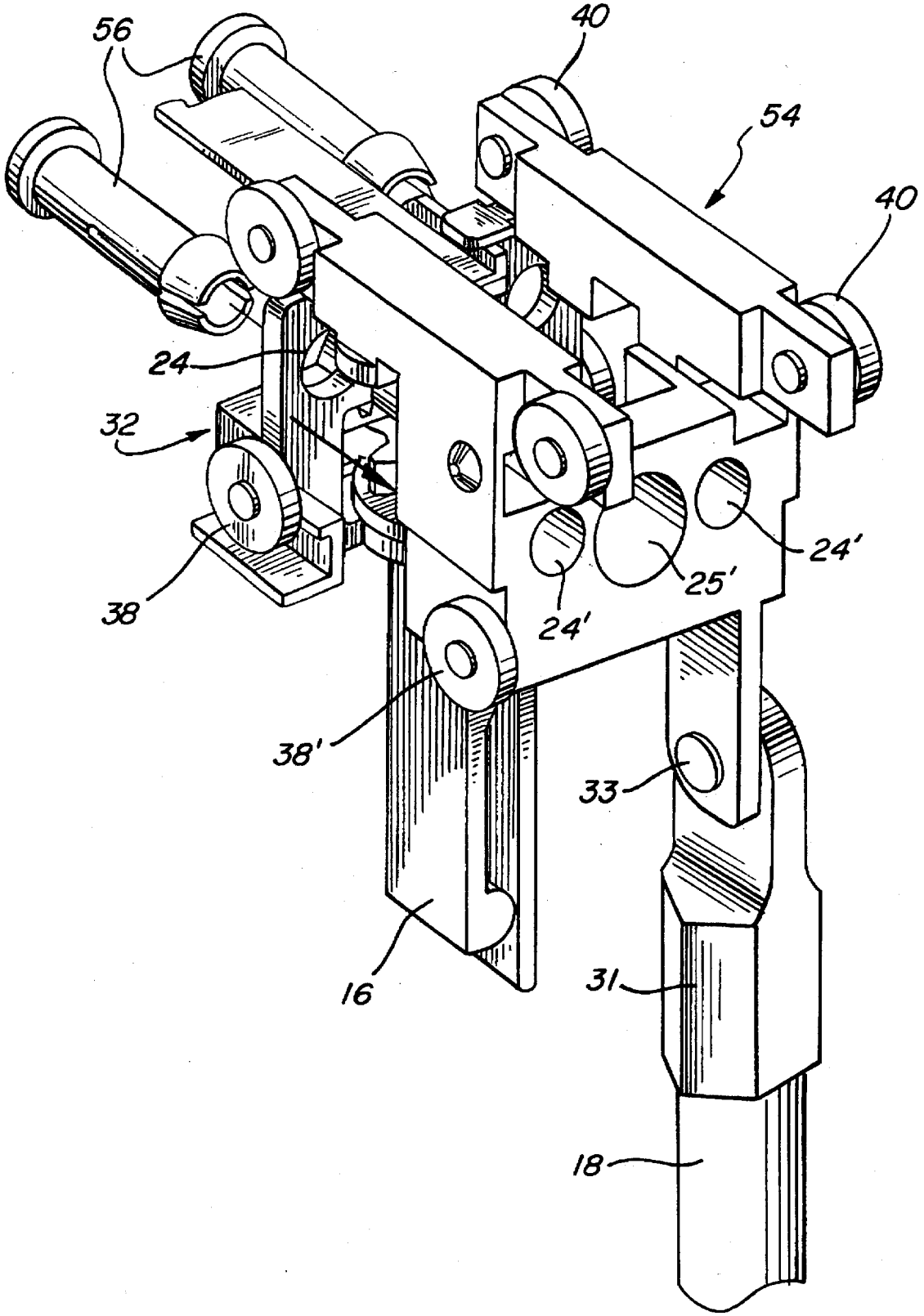
FIG. 7 illustrates a stabilizer assembly of the present invention.

When the blind 8 is opened or closed, the carriers 30, 30' ride on the retaining track 26 of the headrail 10. However, if a carrier 30, 30' is pulled on to open or close the blind, the carrier 30 may tip, causing the retaining track 26 to bind between the retaining ledge 36 and the wheels 38. As illustrated in FIG. 7, this problem can be avoided by equipping the master carrier 32 with an additional set of four top wheels 40 which ride on an inner surface 52 of a top 27 of the headrail 10. The top wheels 40 are spaced apart to have a wide "footprint." Their close contact with the inner surface 52 prevents any tipping and subsequent binding of the master carrier 32.

To reduce the number of different molded parts required, the master carrier 32 actually comprises a normal carrier 30 to which is coupled a stabilizer assembly 54 (see FIG. 7). The wand 18 and its socket 31 are attached by the rivet 33 to the stabilizer assembly 54. This stabilizer assembly 54 carries the four top wheels 40, as well as two additional wheels 38' to stabilize the ride on the retaining track 26. The entire wand assembly 54 is attached to the master carrier 32 by means of two partially-split hollow rivets 56 which pass through the bores 24 of the master carrier 32 and complementary bores 24' of the stabilizer assembly 54. The hollow rivets 56 allow the cord 42 to pass through the master carrier 32 as readily as it does through the open bores 24 of the other carriers 30. Similarly, the splined rod 34 passes through an aperture 25' on the stabilizer assembly 54 which is complementary to aperture 25 of the master carrier 32.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A split-draw vertical slat blind system comprising:

a hollow, longitudinally-extending headrail having a top, two sides, and an opening extending along and entire lower face thereof, retainer tracks borne on either lower edge of the sides, and two open ends;

a first and a second end cap sized for insertion into the open ends of the headrail;

a splined rod extending the length of the headrail and suspended within the headrail by the end caps;

a plurality of identical slat carriers having a central aperture and first and second bores, each slat carrier slidingly supported within the headrail by the splined rod which passes through the central aperture in each slat carrier and by wheels disposed on each slat carrier to ride on the retainer tracks;

a cord forming a closed loop, horizontally disposed with a first side of the loop passing parallel to the splined rod and through the first bores of the plurality of slat carriers on a first side of the rod and a second side of the loop passing parallel to the splined rod and through the second bores of the plurality of slat carriers on a second side thereof, the loop passing around a first reversing means for reversing the cord at the first end cap and a second reversing means for reversing the cord at the second end cap;

a slave carrier comprising one of the plurality of identical carriers being fixed to the cord on one side of the closed loop;

a stabilizer assembly comprising a frame member having first and second bores and shaped for engaging one of the slat carriers with the first and second bores of the frame member aligned with the first and second bores of the slat carriers; a wand attached to the frame member and descending therefrom so that an operator can move the stabilizer assembly and the engaged carrier along the headrail by grasping and moving the wand; and wheels attached to the frame member and disposed to glide along an inner surface of the top of the headrail thereby preventing the stabilizer assembly and the engaged carrier from binding on the retaining tracks when the operator moves the wand; and a master carrier comprising one of the plurality of identical carriers being engaged by the stabilizer assembly, and being fixed to the cord on a side of the closed loop opposite that engaged by the slave carrier so that the master carrier can be moved longitudinally along the headrail by the operator moving the wand, the cord being moved thereby and traveling around the reversing means causing the slave carrier to move in a direction opposite to the master carrier.

2. The blind system of claim 1, wherein one of the reversing means comprises a U-shaped member which guides the cord from the first to the second side of the splined rod.

3. The blind system of claim 1, wherein one of the reversing means comprises a pulley disposed at one end of the headrail to guide the cord from the first to the second side of the splined rod.

4. The blind system of claim 1, wherein the stabilizer assembly further comprises additional wheels disposed to contact the retaining tracks to prevent binding of the master carrier.

5. The blind system of claim 1, wherein the stabilizer assembly engages the master carrier by means of hollow rivets inserted into the first and second bores of the frame member and of the master carrier, the cord passing unimpeded through central foramina of the hollow rivets.

6. A split-draw vertical slat blind system comprising:

a hollow, longitudinally-extending headrail having a top and two sides depending from the top, and opening extending along an entire bottom face thereof, retainer tracks borne by a bottom edge of either side, the retaining tracks projecting into the opening, and two open ends;

a first and a second end cap sized for insertion into the open ends of the headrail;

a splined rod extending the length of the headrail and suspended within the headrail by the end caps;

a plurality of slat carriers each slidingly supported within the headrail by the splined rod which passes through a central aperture of each carrier and by wheels disposed on each slat carrier to ride on the retainer tracks, each slat carrier also having a bore on either side of the central aperture;

a cord forming a horizontally disposed closed loop, with a first side of the loop passing parallel to the splined rod through the bores of the slat carriers on a first side of the rod and a second side of the loop passing parallel to the splined rod through the bores of the slat carriers on a second side thereof, the cord passing around a first reversing means for reversing the cord at the first end cap and a second reversing means for reversing the cord at the second end cap;

a slave carrier comprising one of the plurality of carriers being fixed to the cord on one side of the closed loop;

a stabilizer assembly comprising a frame member having a central aperture, a bore on either side of the central aperture, and shaped for engaging one of the carriers by means of hollow rivets inserted into the bores of the frame member and corresponding bores of the engaged carrier; a rod-like wand attached to the frame member and descending therefrom so that an operator can move the stabilizer assembly and the engaged carrier along the headrail by grasping and moving the wand; and wheels attached to the frame member and disposed to glide along an inner surface of the top of the headrail thereby preventing the stabilizer assembly and the engaged carrier from tipping and binding on the retaining tracks when the operator moves the wand; and a master carrier comprising one of the plurality of carriers being engaged by the hollow rivets to the stabilizer assembly so that the cord passes through the hollow rivets, and being fixed to the cord on a side of the closed loop opposite that engaged by the slave carrier so that the master carrier can be moved longitudinally along the headrail by the operator moving the wand causing the cord to travel around the reversing means thereby causing the slave carrier to move in a direction opposite to the master carrier.

7. The blind system of claim 6, wherein one of the reversing means comprises a U-shaped member which guides the cord from the first to the second side of the splined rod.

8. The blind system of claim 6, wherein one of the reversing means comprises a pulley disposed at one end of the splined rod to guide the cord from the first to the second side.

9. The blind system of claim 6, wherein the stabilizer assembly further comprises additional wheels disposed to contact the retaining tracks to prevent binding of the master carrier.

10. A split-draw vertical blind system comprising:

a hollow, longitudinally-extending headrail;

a cord passing around reversing means at either end of the headrail, the reversing means defining a first and a second substantially parallel cord segment;

a plurality of identical slat carriers slidingly supported within the headrail and having two bores disposed side by side so that the first cord segment passes freely though the bores on a first side of the slat carriers and the second cord segment passes freely through the bores on a second side;

a slave carrier comprising a first centrally located one of the identical slat carriers being fixed to the first cord segment;

a master carrier comprising a second centrally located one of the identical slat carriers disposed next to the slave carrier and being fixed to the second cord segment so that moving the master carrier longitudinally along the headrail moves the slave carrier in a direction opposite to the master carrier; and a stabilizing assembly having two bores disposed side by side in alignment with the two bores of the master carrier so that the first and second cord segments pass therethrough, the stabilizing assembly having a stabilizing portion engaging the longitudinally-extending headrail with a substantially wider "footprint" than the master carrier alone;

means for attaching the stabilizing assembly to the master carrier to form a stabilized master carrier that is unlikely to bind when being pushed or pulled along the longitudinally-extending headrail; and grasping means attached to the stabilizing assembly of the stabilized master carrier for slidingly moving the stabilized master carrier in a desired direction along the headrail.

11. The blind system of claim 10, wherein the grasping means comprises a rod-like wand depending from the master slat carrier.

12. The blind system of claim 10, wherein the means for attaching the stabilizing assembly to the master carrier comprises hollow rivets inserted into the aligned bores of the stabilizing assembly and master carrier.

13. A split-draw vertical slat blind system comprising:

a longitudinally-extending headrail;

a first and a second plurality of slat carriers slidingly supported by the headrail between a central position and a first and a second end of the headrail;

a master carrier slidingly supported by the headrail at the central position relative to the first plurality of slat carriers and comprises a stabilizing assembly to prevent the master carrier from binding in the headrail;

a slave carrier, next to the master carrier, slidingly supported by the headrail at the central position relative to the second plurality of slat carriers;

grasping means for moving the master carrier along the headrail from the central position toward the first end of the headrail to place the first plurality of slats in an open position and from the first end of the headrail to the central position to place the first plurality of slats in a closed position; and moving means connecting the slave carrier and the master carrier for simultaneously moving the slave carrier a direction opposite to the master carrier when the grasping means moves the master carrier, the second plurality of slats being placed in an open position when the slave carrier is moved from the central position towards the second end of the headrail and in a closed position when the slave carrier is moved from the second end to the central position;

wherein each slat carrier further comprises two bores disposed side by side and wherein the moving means comprises a cord which passes through the bores; and wherein the stabilizing assembly is attached to the master carrier by means of hollow rivets which define the two bores.

14. The blind system of claim 13, wherein the grasping means comprises a rod-like wand.

* * * * *